US012729042B2

(12) United States Patent
Dolph et al.

(10) Patent No.: US 12,729,042 B2
(45) Date of Patent: Sep. 8, 2026

(54) CONTAINER LID

(71) Applicant: Pacific Market International, LLC, Seattle, WA (US)

(72) Inventors: Matthew Dolph, Seattle, WA (US); Ryan M. Smith, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 64 days.

(21) Appl. No.: 18/883,096

(22) Filed: Sep. 12, 2024

(65) Prior Publication Data

US 2025/0002234 A1 Jan. 2, 2025

Related U.S. Application Data

(63) Continuation of application No. PCT/US2024/028616, filed on May 9, 2024.

(60) Provisional application No. 63/457,157, filed on Apr. 5, 2023.

(51) Int. Cl.
*B65D 47/08* (2006.01)
*B65D 51/16* (2006.01)

(52) U.S. Cl.
CPC ..... *B65D 47/0857* (2013.01); *B65D 51/1672* (2013.01)

(58) Field of Classification Search
CPC ..... B65D 47/0857; B65D 51/1672; B65D 47/265; B65D 43/18; B65D 25/42; B65D 85/72; A47G 19/2272
See application file for complete search history.

(56) References Cited

U.S. PATENT DOCUMENTS

| | | | | |
|---|---|---|---|---|
| 4,190,173 | A * | 2/1980 | Mason | A47J 41/0027 222/548 |
| 5,294,014 | A * | 3/1994 | Wyatt | B65D 47/265 222/472 |
| 6,010,029 | A † | 1/2000 | Wang | |
| D659,747 | S | 5/2012 | Wahl | |
| D805,838 | S | 12/2017 | Guthrie | |
| D808,722 | S | 1/2018 | Hill | |
| 11,577,892 | B2 * | 2/2023 | Wong | B65D 47/061 |

(Continued)

FOREIGN PATENT DOCUMENTS

| | | | |
|---|---|---|---|
| CN | 201499948 U | † | 6/2010 |
| CN | 110200461 A | † | 9/2019 |

(Continued)

OTHER PUBLICATIONS

PCT International Search Report and Written Opinion in Application PCT/US2024/028616, dated Jan. 29, 2025, 18 pages.

(Continued)

*Primary Examiner* — Andrew D Perreault
(74) *Attorney, Agent, or Firm* — Merchant and Gould, PC

(57) ABSTRACT

A container lid includes a base defining (1) a base receiver centrally disposed in the base, and (2) a drinking opening off-center in the base. A cover, defining a straw opening, includes a catch rotatably disposed in the receiver. A gasket defines a slit aligned with the straw opening for receiving a straw. The cover is rotatably positionable in a first position where the slit is aligned with the drinking opening. The cover is rotatably positionable in a second position where the slit is mis-aligned with the drinking opening.

17 Claims, 13 Drawing Sheets

(56) References Cited

U.S. PATENT DOCUMENTS

| | | | | |
|---|---|---|---|---|
| 12,503,282 | B2 * | 12/2025 | Wong | B65D 47/2031 |
| 2005/0127075 | A1 † | 6/2005 | Ishimitsu | |
| 2008/0142519 | A1 † | 6/2008 | Chou | |
| 2010/0102059 | A1 * | 4/2010 | Ruse, Jr. | B65D 43/0204 220/254.5 |
| 2014/0069944 | A1 † | 3/2014 | Shapiro | |
| 2016/0198878 | A1 * | 7/2016 | Gilbert | A47G 19/2272 220/262 |
| 2017/0208975 | A1 * | 7/2017 | Ross | A47G 19/2272 |
| 2021/0102059 | A1 | 4/2021 | Sato | |
| 2021/0139204 | A1 * | 5/2021 | Bitzaya | B65D 43/0214 |
| 2021/0267392 | A1 | 9/2021 | Rechsteiner | |
| 2021/0282585 | A1 * | 9/2021 | Lee | A47J 31/20 |
| 2023/0029205 | A1 * | 1/2023 | Omdahl, II | A47G 19/2222 |
| 2025/0002234 | A1 | 1/2025 | Dolph | |
| 2025/0058943 | A1 * | 2/2025 | Whitworth | B65D 47/0876 |

FOREIGN PATENT DOCUMENTS

| | | | |
|---|---|---|---|
| CN | 211984853 | U † | 11/2020 |
| CN | 217065979 | U † | 7/2022 |
| DE | 015022679 | | 5/2023 |
| DE | 0150227090001 | | 5/2023 |
| JP | 1768104 | | 4/2024 |
| WO | 2024/238279 | | 11/2024 |

OTHER PUBLICATIONS

Partial International Search Report for PCT/US2024/028616, dated Dec. 4, 2024, 16 pages.

Search report from the Turkish Patent and Trademark Office, with English translation, dated May 7, 2025, 13 pages.

https:www.youtube.com/watch?v=dJxt7IQRoq0&ab_channel=StanleyBrand, Quencher H2O Flow State Tumbler dated Aug. 29, 2022, 1 page.

https://www.youtube.com/shorts/aHFSR9hWmJw, Stanley Tumbler, dated Oct. 29, 2022, 1 page.

https:www.youtube.com/watch?v=IDFxehJy6jY&ab_channel=JustADadTips, Stanley Quencher H2O Tumbler with Straw Lid and Handle, dated Dec. 7, 2022, 1 page.

* cited by examiner
† cited by third party

CONTAINER LID

CROSS-REFERENCE TO RELATED APPLICATIONS

This application is a continuation of PCT Application Serial No. PCT/US2024/28616, filed May 9, 2024, which claims priority to U.S. Provisional Patent Application Ser. No. 63/457,157, filed Apr. 5, 2023, the disclosures of which are incorporated herein by reference in their entireties.

BACKGROUND

Drinking containers with various types of lids are used to contain a liquid or beverage for drinking as needed. Such lids may include a drinking opening through which a beverage may be consumed, for example, by tilting the drinking container. The drinking opening may be blocked by a tab formed with the cover, but this tab rarely sufficiently seals the drinking opening, causing leakage if the container is shaken or tilted. Certain lids may enable access to the liquid via a straw inserted through a slit in the lid, but these slits often allow leakage as well.

SUMMARY

In an aspect, the technology relates to a container lid including: a base defining (1) a base receiver centrally disposed in the base, and (2) a drinking opening off-center in the base; and a cover defining a straw opening, wherein the cover includes: a catch rotatably disposed in the receiver; and a gasket defining a slit aligned with the straw opening for receiving a straw, wherein the cover is rotatably positionable in a first position where the slit is aligned with the drinking opening, and wherein the cover is rotatably positionable in a second position where the slit is mis-aligned with the drinking opening. In an example, when the cover is in the second position, the drinking opening is exposed. In another example, the gasket includes a head, a tail, and a base connecting the head and the tail, wherein the head defines the slit. In yet another example, the head and the tail are substantially coplanar and disposed in a first plane and wherein the base is disposed in a second plane non-coplanar to the first plane. In still another example, the cover defines an opposite opening disposed opposite the straw opening, and wherein the head extends through the straw opening, and wherein the tail extends through the opposite opening.

In another example of the above aspect, the gasket further defines an anchor and wherein the cover defines an anchor receiver for receiving the anchor, and wherein the anchor, anchor receiver, and the base receiver are aligned. In an example, the base includes an upper surface and the cover defines a lower surface. In another example, the upper surface of the base at least partially defines a first receptor and a second receptor and wherein the cover includes a detent extending from the lower surface of the cover. In yet another example, when the cover is in the first position, the detent is engaged with the first receptor and wherein when the cover is in the second position, the detent is engaged with the second receptor. In still another example, the gasket includes a plurality of deflectable flaps.

In another example of the above aspect, the container lid further includes an O-ring disposed around the catch. In an example, the base receiver defines a plurality of vent channels. In another example, the cover covers the plurality of vent channels when in the first position and in the second position. In yet another example, the cover is positionable in a third position where the tail is aligned with the drinking opening and wherein when the cover is in the second position, the tail is mis-aligned with the drinking opening. In still another example, an upper surface of the base at least partially defines a first receptor, a second receptor, and a third receptor, and wherein the cover includes a detent extending from a lower surface of the cover.

In another example of the above aspect, when the cover is in the first position, the detent is engaged with the first receptor; when the cover is in the second position, the detent is engaged with the second receptor; and when the cover is in the third position, the detent is engaged with the third receptor. In an example, a beverage contained includes the container lid.

In another aspect, the technology relates to a method of using a container lid including a base defining a drinking opening and a cover rotatably secured to the base, wherein the cover includes a straw opening defined by a gasket, the method includes: disposing the cover in a first rotated position, wherein when in the first rotated position, the straw opening is aligned with the drinking opening; disposing the cover in a second rotated position, wherein when in the second rotated position, the drinking opening is exposed; and disposing the cover in a third rotated position, wherein when in the third rotated position, the seal is aligned with the drinking opening. In an example, the method further includes inserting a straw into the straw opening when the cover is in the first position, thereby displacing the gasket. In another example, the container lid includes a detent and receptor and wherein disposing the cover in at least one of the first position, the second position, and the third position engages the detent with the receptor.

DETAILED DESCRIPTION

A lid for a beverage container (examples of which may be described as a reusable or disposable cup, tumbler, vessel, or the like) is described herein. The container lid is structured so as to rotatably position a cover thereof on the container lid in multiple positions. In a first position, the cover is positioned such that a straw may be inserted into the container, via the container lid and a drinking opening therein. A gasket is disposed in an opening in the cover and the straw is inserted therethrough; this reduces or prevents leakage of liquid if the container is agitated or tipped over. In a second position, the cover is positioned such that the drinking opening of the container lid is exposed and accessible, thereby enabling a user to drink from the container without a straw (e.g., directly with her lips in contact with the lid). In a third position, the cover is positioned so as to cover the drinking opening, which may partially or completely prevent leaks therethrough. Pressure applied to draw liquid from the container (e.g., during use of the straw, or when pouring the liquid directly into the mouth) may be relieved via a vent in the container lid.

Rotation of the cover between the three positions is made easier by the presence of one or more detents on either or both of the lid base and lid cover. When rotating between the three positions described above, the detent(s), slide along an upper surface of the lid base, thus forming a space or gap between that upper surface and a bottom surface of the cover. This reduces friction between the base and the cover so as to allow for easy rotation. At certain positions, the detent(s) may engage with one or more receptors on the other of the base and the cover, which both properly positions the cover in the desired position and provides a tactile or audible indication to the user that the cover is properly positioned. Further, engagement of the detent(s) with the receptor(s) aids in keeping the cover in the proper position. The depicted lid configuration includes a number of these structural features, but any lesser number of structural features may be combined as required or desired for a particular application. Thus, the structure of the lid, including one or more of the above features, helps prevent liquid within the container from leaking out of the container during movement thereof.

Figure 1A:
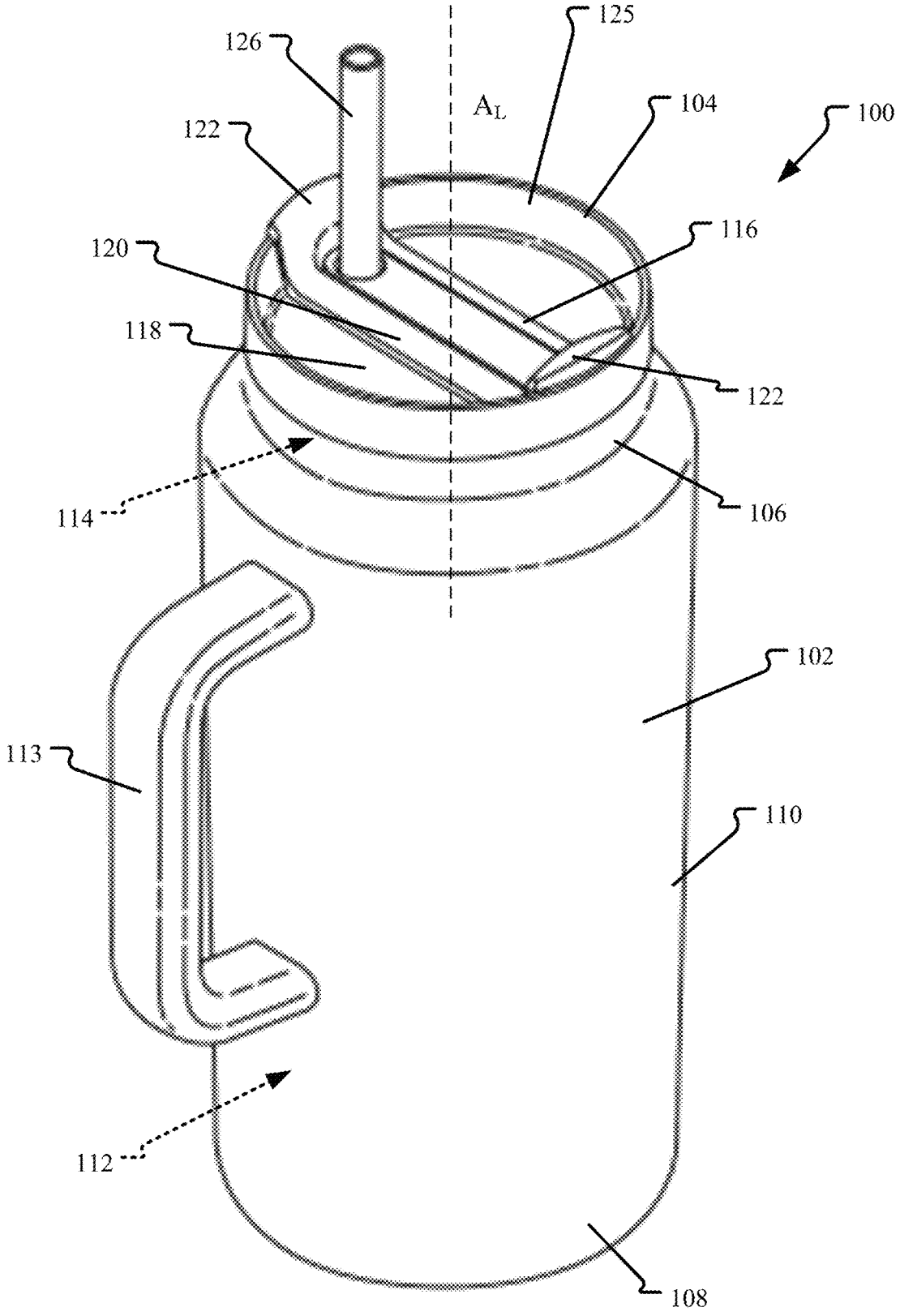
FIG. 1A depicts a perspective view of an exemplary container having a container body and a container lid.
Figure 1B:
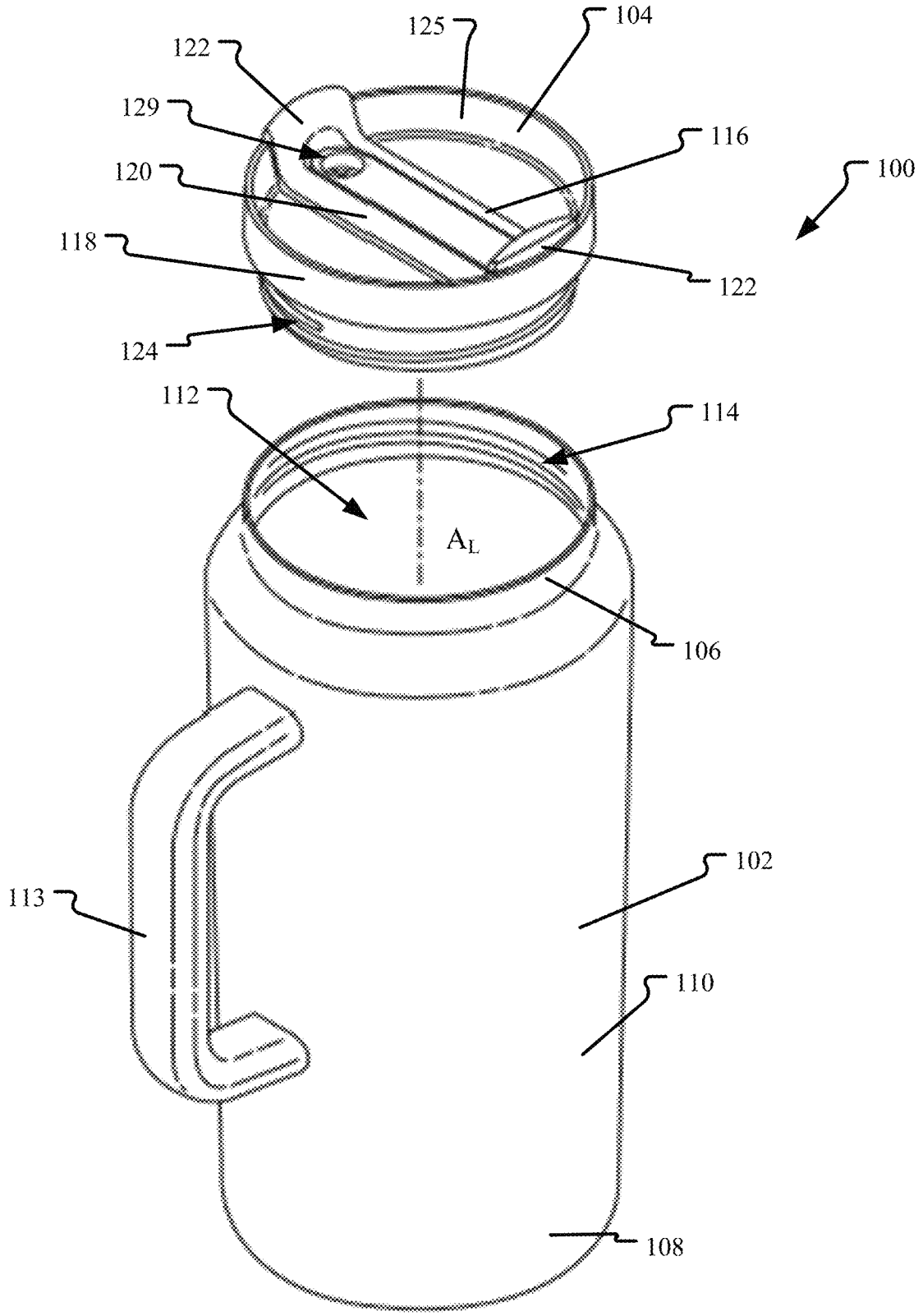
FIG. 1B depicts a perspective view of the container of FIG. 1A with the container body separated from the container lid.

FIG. 1A illustrates a perspective view of an exemplary container 100 having a container body 102 and a container lid 104. FIG. 1B illustrates a perspective view of the container 100 of FIG. 1 with the container body 102 separated from the container lid 104. FIGS. 1A and 1B are described concurrently and not every feature described herein is visible in both figures. The container 100 is illustrated as a reusable tumbler, but may alternatively take the form of a glass, mug, goblet, stein, tankard, vessel, beaker, drinkware, beverageware, or other vessel for holding liquid beverages for consumption. While the container 100 is described as being for liquids, the container 100 may be used for containing any other substances, materials, or items as required or desired.

The container body 102 has an upper end portion 106, an opposite lower end portion 108, and a middle portion 110 extending therebetween. The container body 102 defines an interior chamber 112 configured to hold liquids therein. The upper end portion 106 is open for access to the interior chamber 112 and the lower end portion 108 is enclosed. The interior chamber 112 extends from the upper end portion 106 into the middle portion 110 and towards the lower end portion 108. In the example, the container body 102 has a substantially cylindrical shape with the upper end portion 106 having a slightly smaller diameter than the lower end portion 108, though other container configurations (e.g., tapered, stepped, pitched, etc.) are contemplated. As illustrated, the container body 102 includes a handle 113. In another example, however, the container body 102 need not include a handle. The container body 102 may be formed from plastic. In other aspects, the container body 102 can be formed from glass, ceramics, stainless steel, etc., or combinations thereof. The container body 102 may also be manufactured so as to provide insulation for the liquids contained therein from a surrounding environment. For example, the container body 102 may have a single or a double wall construction. In other examples, one or more ribs or other features (not shown) may be provided on the container body 102 to improve gripping or grasping thereof.

The container lid 104 is configured to removably couple to the container body 102. For example, the upper end portion 106 of the container body 102 includes a container engaging portion 114 to be secured to the container lid 104. In the example, the container lid 104 includes a base 118 and a cover 120 that are rotatably engaged to reduce or prevent leakage, as described below. The cover 120 includes a rotatable body 116 defined by two raised ends 122, which allow for easy rotation of the cover 120. The cover 120 rotates about a lid axis $A_L$ so as to position the lid 104 in various conditions (defined, for example, by positions of the cover 120, as described herein). The base 118 may include a threaded outer interface 124 to threadably engage with threads disposed on the container engaging portion 114, although other types of attachment systems are contemplated, such as bayonet, press fit, etc. The raised ends 122 are disposed so as to rotate within a raised rim 125 of the base 118. A straw 126 extends down from the container lid 104 into the interior chamber 112 of the container body 102, via a straw opening 129.

Figure 2A:
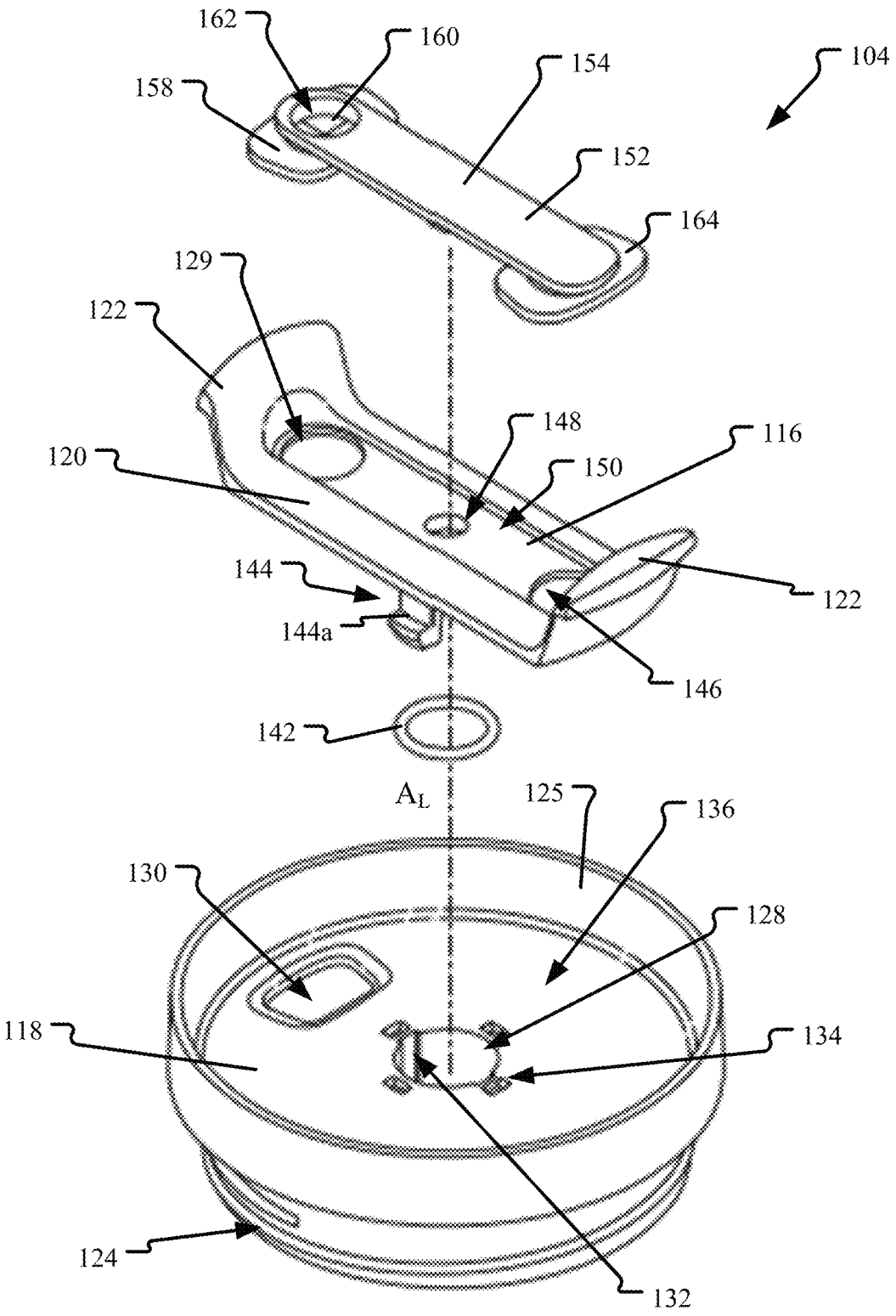
FIGS. 2A and 2B depict an enlarged exploded top perspective view and an enlarged exploded bottom perspective view, respectively, of the container lid of FIGS. 1A and 1B.
Figure 2B:
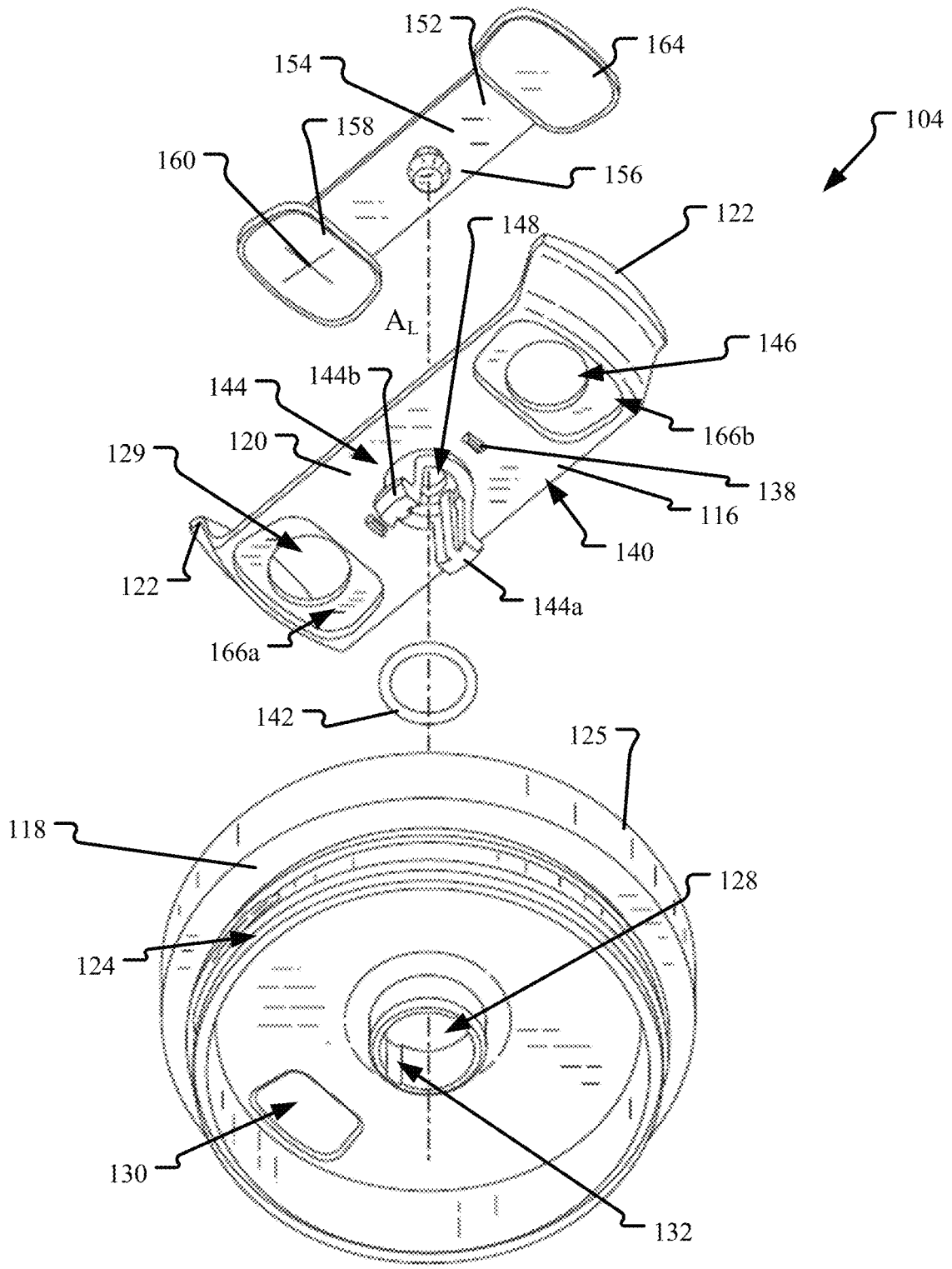

FIGS. 2A and 2B depict an enlarged exploded top perspective view and an enlarged exploded bottom perspective view, respectively, of the container lid 104 of FIGS. 1A and 1B. FIGS. 2A-2B are described concurrently and not all components described are depicted in all figures, and certain components described above in FIGS. 1A and 1B are not necessarily described further. The container lid 104 includes the base 118 and the cover 120. The base 118 includes a threaded outer interface 124 for engaging with a corresponding interface on the container body (not shown). The base 118 defines a base receiver 128 centrally disposed on the axis $A_L$ and a drinking opening 130 off-center therefrom. The base receiver 128 defines a plurality of vent channels 132 in the form of slots that extend along the receiver 128. Disposed around the receiver 128 are a plurality of receptors 134 which are formed as recesses in an upper surface 136 of the base 118. The receptors 134 are positioned so as to engage with one or more detents 138 disposed on a lower surface 140 of the cover 120, when the cover 120 is rotated into certain predetermined positions. An O-ring 142 is disposed around a catch 144 that extends from the cover 120 and helps seal an interface between the base 118 and the cover 120 to prevent or restrict liquid from within the container from leaking therefrom. The catch 144 projects within the base receiver 128 and rotatably secures the cover 120 to the body 118, with a pair of tines 144*a*, 144*b*.

The body 116 of the cover 120 defines a plurality of openings and receivers, specifically, the straw opening 129 and an opposite opening 146 (so named because it is opposite the straw opening 129), and an anchor receiver 148 disposed therebetween. Each of the straw opening 129, the opposite opening 146, and the anchor receiver 148 are located within a gasket recess 150, which is configured to receive a gasket 152. The gasket 152 may be made of a rubber, silicon, or other material different than the plastic used for the construction for the other portions of the lid 104. This allows for a different tactile feel of the gasket 152 and other performance advantages, as described below.

The gasket 152 includes an elongate base 154 from which an anchor 156 projects, and which is sized so as to be received in the gasket recess 150. A head portion 158 is disposed at a first end of the elongate base 154 and defines at least one slit 160 at a straw opening 162 thereof for receiving the straw (not shown). A tail portion 164 is disposed at an opposite end of the elongate base 154. Each of the head portion 158 and the tail portion 164 include an outer perimeter configured to mate with a corresponding recess 166*a*, 166*b* on the bottom surface 140 of the cover 120. This allows these portions of the gasket 152 to remain relatively elevated from the lower surface 140, so as to reduce friction when the cover 120 is rotated relative to the base 118. The position of the detents 138 also allows the cover 120 to be elevated relative to the upper surface 136 of the base 118 during rotation, as described elsewhere herein.

Figure 3A:
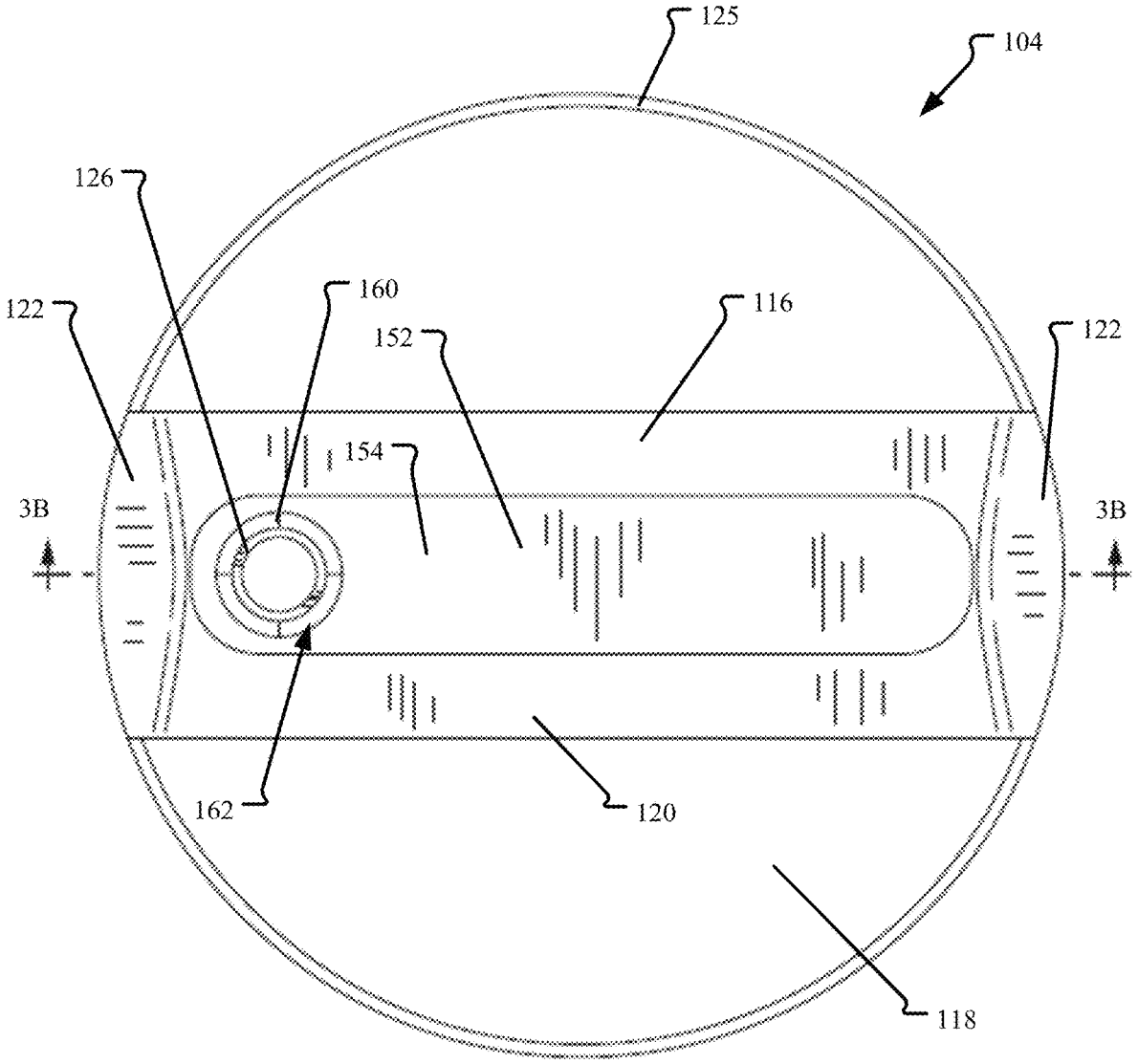
FIGS. 3A and 3B depict a top view and a sectional view, respectively, of the container lid of FIGS. 1A and 1B in a first, straw-receiving position.
Figure 3B:
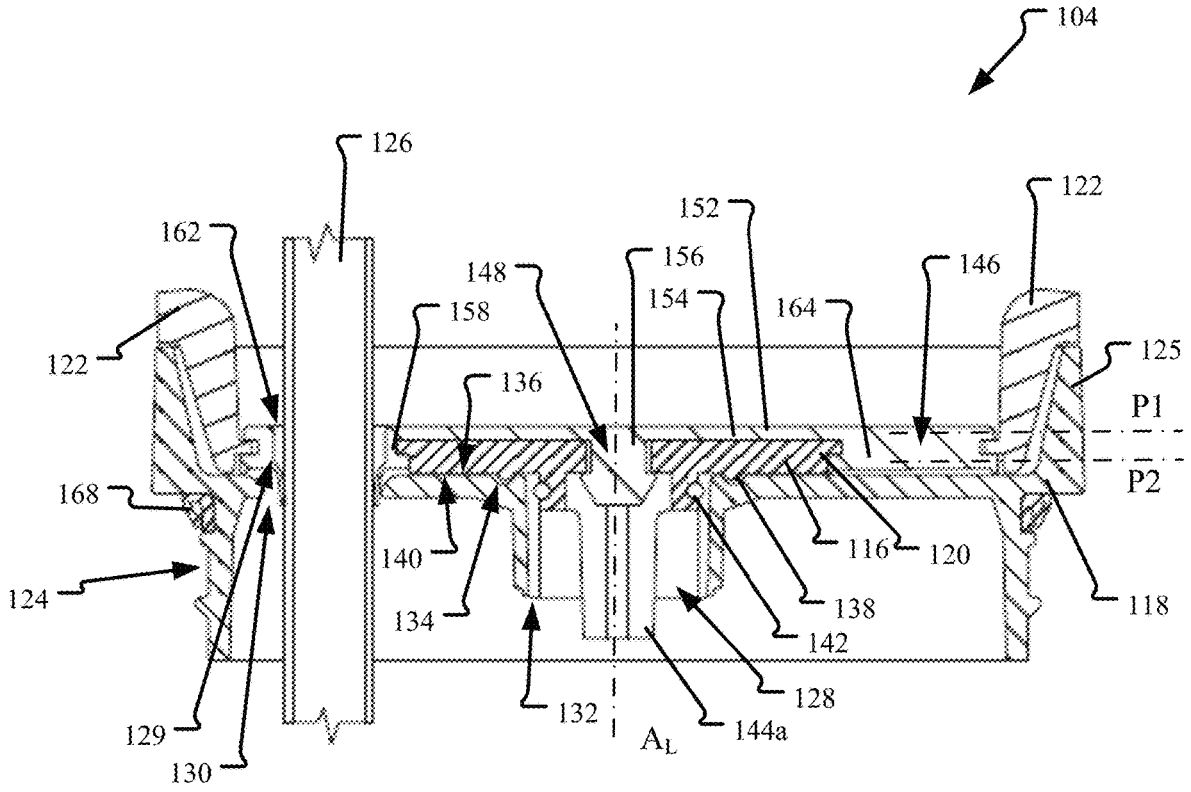

FIGS. 3A and 3B depict a top view and a sectional view, respectively, of the container lid 104 of FIGS. 1A and 1B in a first, straw-receiving position. FIGS. 3A-3B are described concurrently and not all components described are depicted in all figures, and certain components described above in FIGS. 1A-2B are not necessarily described further. The gasket 152 is secured to the cover 120 at the anchor 156, the head portion 158, and the tail portion 164. The central base 154 defines a first plane P1 that is located above the portion of the cover 120 that defines the straw opening 129 and the opposite opening 146. The head portion 158 and the tail portion 164 are enlarged and define a plane P2 that is located below the portion of the cover 120 that defines the straw opening 129 and the opposite opening 146. Thus, these planes P1 and P2 are non-coplanar and aid in sealing these penetrations against leaks therethrough. Sealing between the base 118 of the lid 104 and the container (not shown) is by way of the threaded connection 124 depicted, as well as a perimeter gasket 168 located adjacent thereto.

In the straw-receiving position of FIGS. 3A-3B, the drinking opening 130 in the base 118 is aligned with the straw opening 129 in the cover 120, in which is positioned the straw opening 162 in the head portion 158 of the gasket 152. As such, the straw 126 may be inserted through the slit 160 into the interior chamber of the container (not shown). The portion of the gasket 152 that defines the slit 160 thus forms a plurality of flaps 161*a*, 161*b*, 161*c*, and 161*d* that deflect downward and substantially surround the straw 126, so as to reduce or prevent leakage therethrough. Each of the gasket 152 (at the gasket anchor 156), the anchor receiver 148, and the base receiver 128 are aligned along the lid axis $A_L$. As depicted in FIG. 3B, in the straw-receiving position, two detents 138 are engaged with two receptors 134. In other examples, a different number of detents may be used with multiple receptors, each receptor positioned such that engagement with a detent occurs when the cover is disposed in predetermined positions.

Figure 4A:
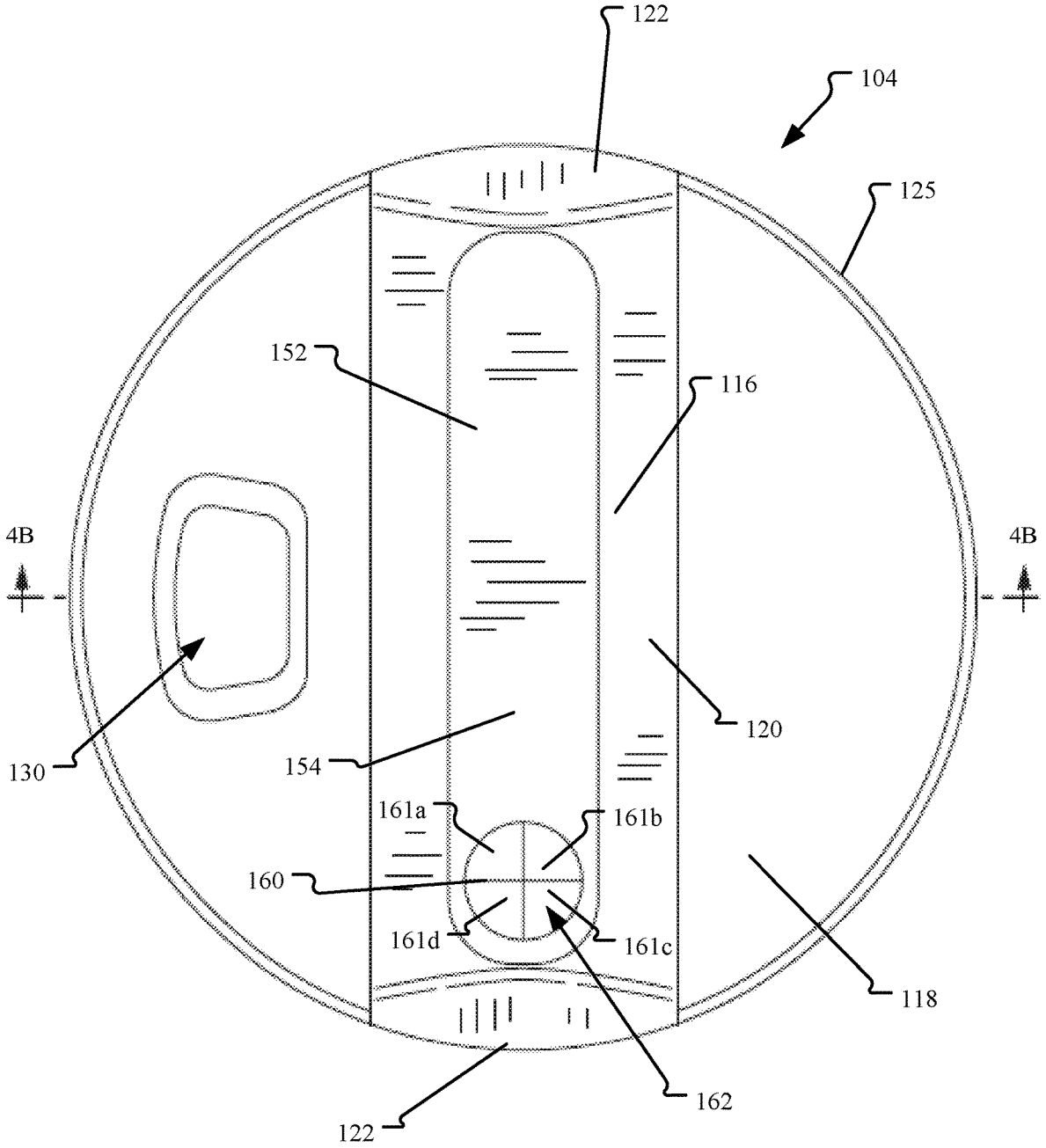
FIGS. 4A and 4B depict a top view and a sectional view, respectively, of the container lid of FIGS. 1A and 1B in a second, open position.
Figure 4B:
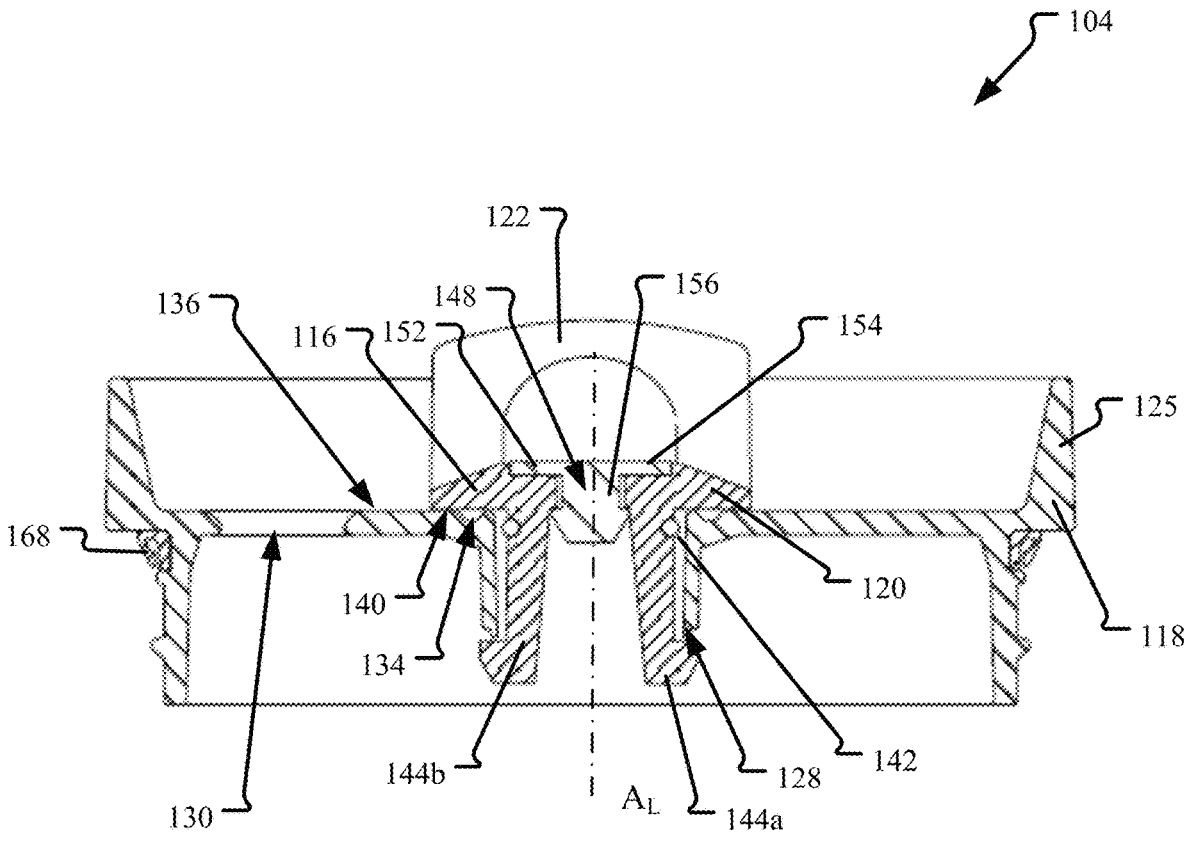

FIGS. 4A and 4B depict a top view and a sectional view, respectively, of the container lid 104 of FIGS. 1A and 1B in a second, open position. FIGS. 4A-4B are described concurrently and not all components described are depicted in all figures, and certain components described above in FIGS. 1A-3B are not necessarily described further. Engagement between the tines 144*a*, 144*b* of the catch 144 and the receiver 128 is depicted. In the depicted example, the cover 120 is rotated about 90 degrees, relative to the straw-receiving position of FIGS. 3A and 3B. In this position, the drinking opening 130 is misaligned with the straw opening 129. The cover 120 is positioned so as to not hinder access of a user to the drinking opening 130 for example, by placing her mouth proximate the raised rim 125 of the base 118 and tilting the container to pour liquid through the drinking opening 130. As depicted, in the open position, two detents are disengaged from two receptors 134, though engagement in this position occurs with detents and receptors disposed in a section about 90° to the depicted section.

Figure 5A:
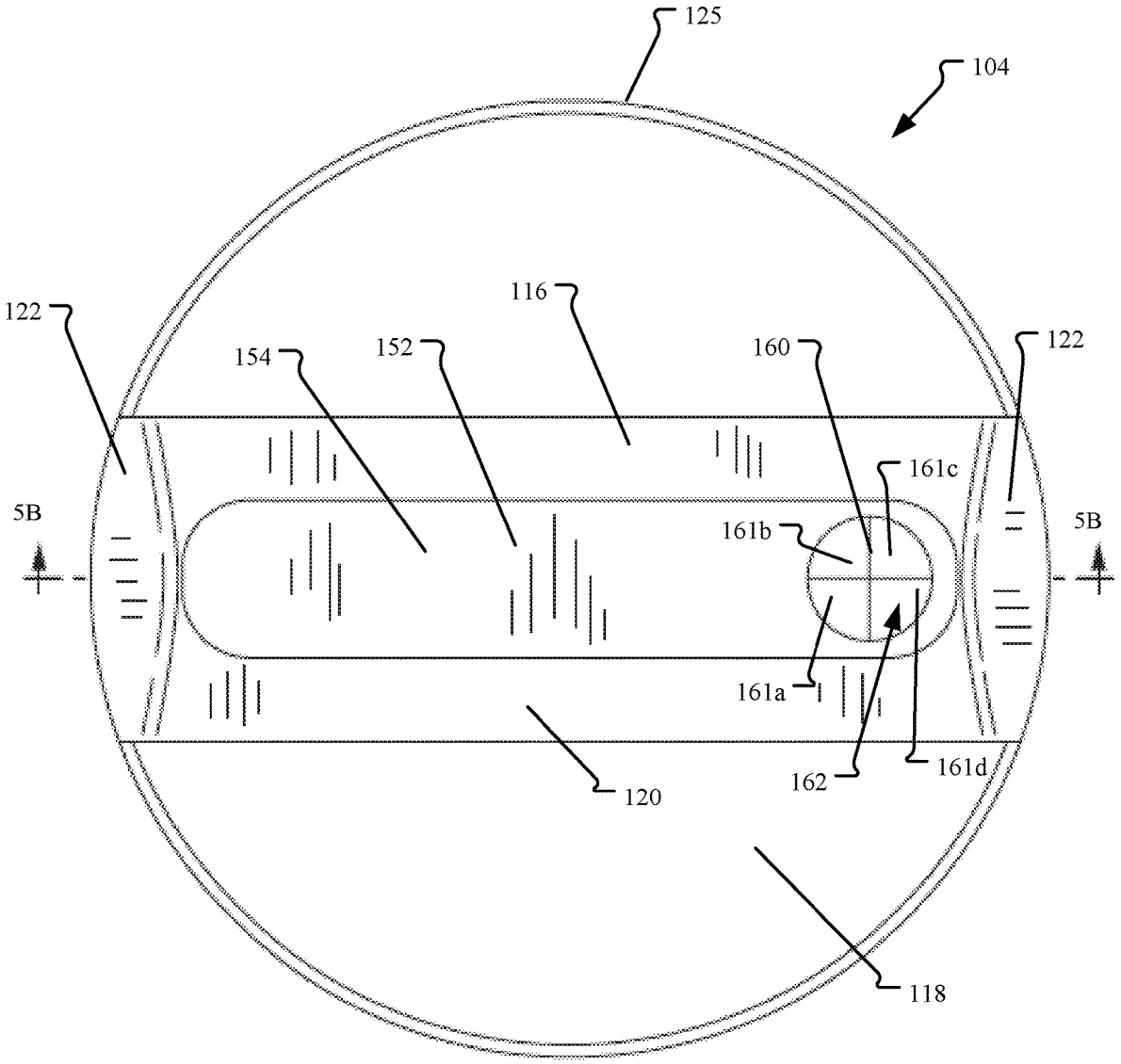
FIGS. 5A and 5B depict a top view and a sectional view, respectively, of the container lid of FIGS. 1A and 1B in a third, closed position.
Figure 5B:
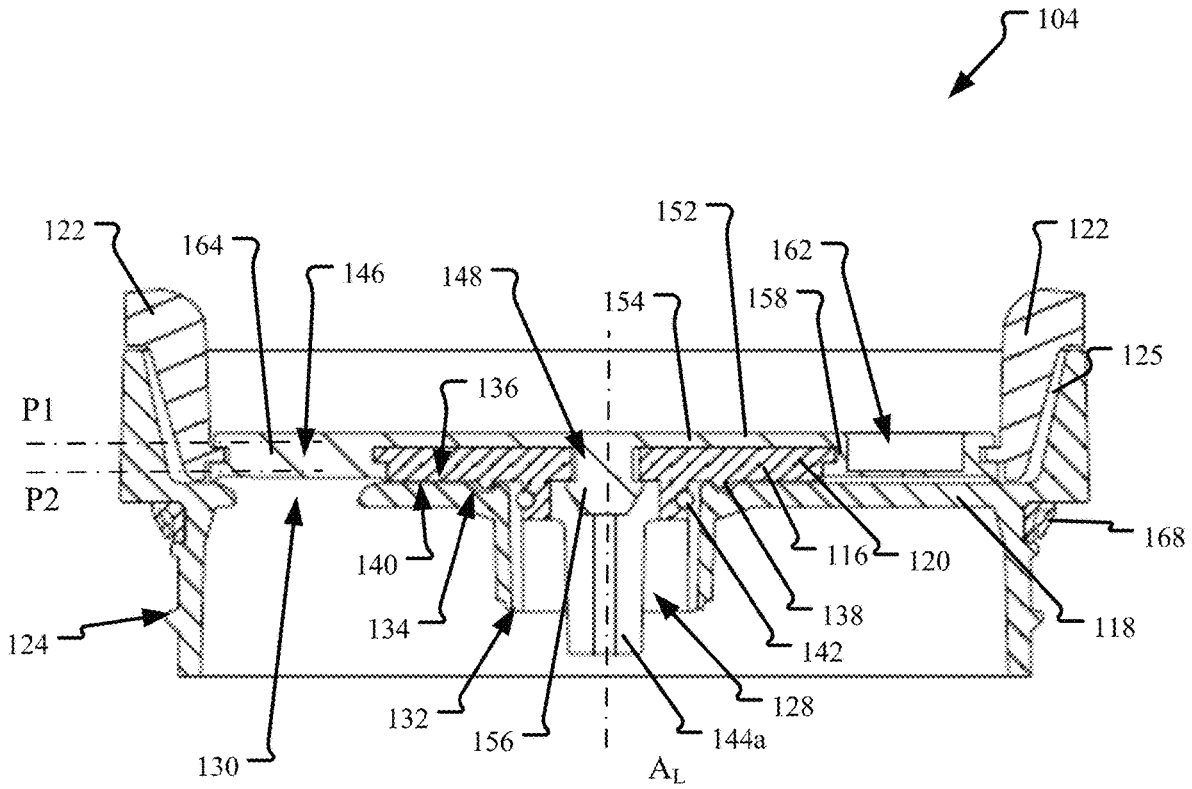

FIGS. 5A and 5B depict a top view and a sectional view, respectively, of the container lid 104 of FIGS. 1A and 1B in a third, closed position. FIGS. 4A-4B are described concurrently and not all components described are depicted in all figures, and certain components described above in FIGS. 1A-4B are not necessarily described further. In the depicted example, the cover 120 is rotated about 180 degrees, relative to the straw-receiving position of FIGS. 3A and 3B. In this position, the drinking opening 130 is covered by the tail portion 164 of the gasket 152, thereby reducing or preventing leakage therethrough. The portion of the gasket 152 defining the slit 160 is positioned opposite thereto, with the slit 160 in a substantially closed configuration. As depicted, in the closed position, two detents 138 are engaged with two receptors 134, though engagement between other numbers of detents and receptors is also contemplated, as noted above.

Figure 6A:
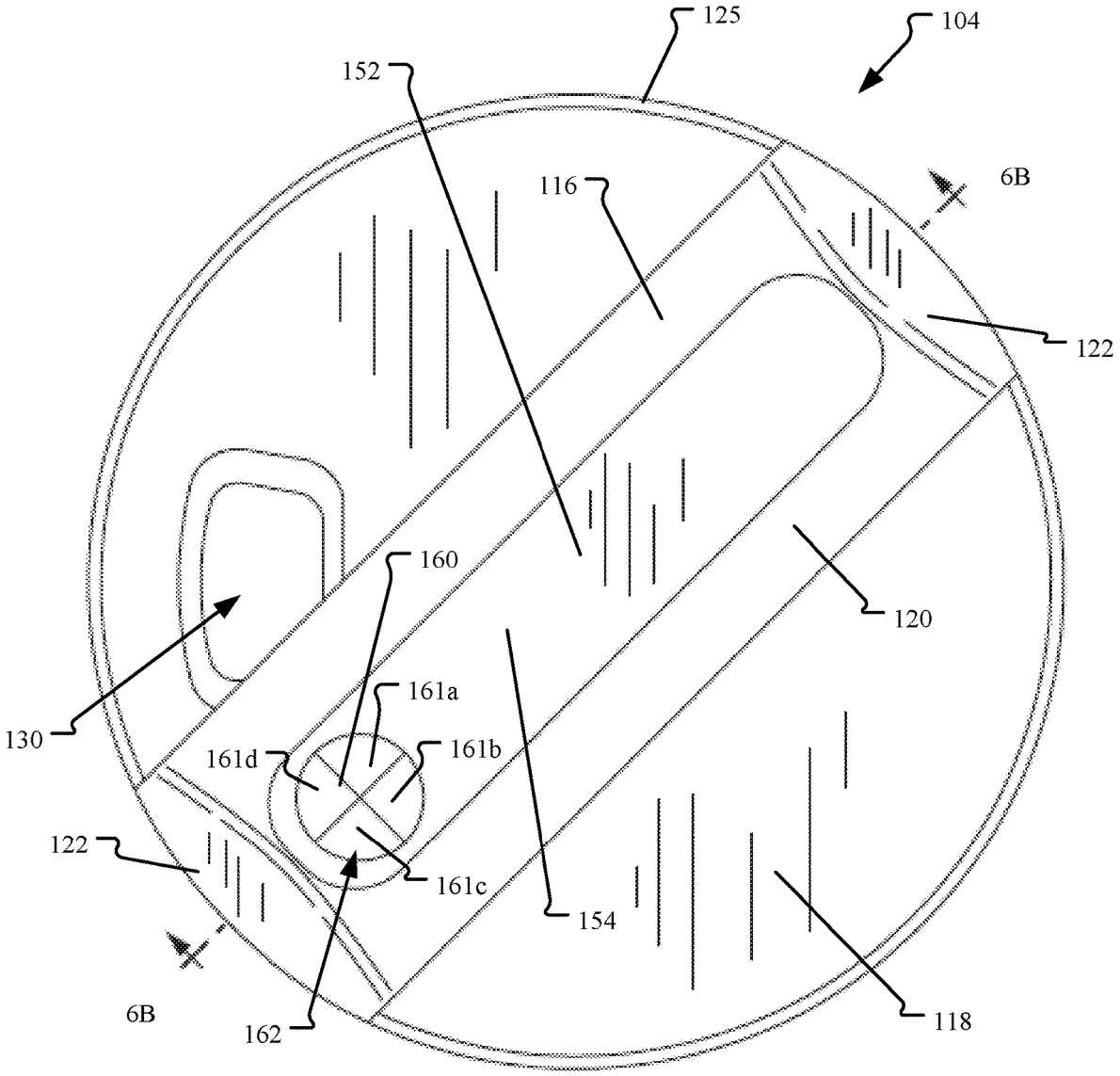
FIGS. 6A and 6B depict a top view and a sectional view, respectively, of the container lid of FIGS. 1A and 1B in a fourth, intermediate position.
Figure 6B:
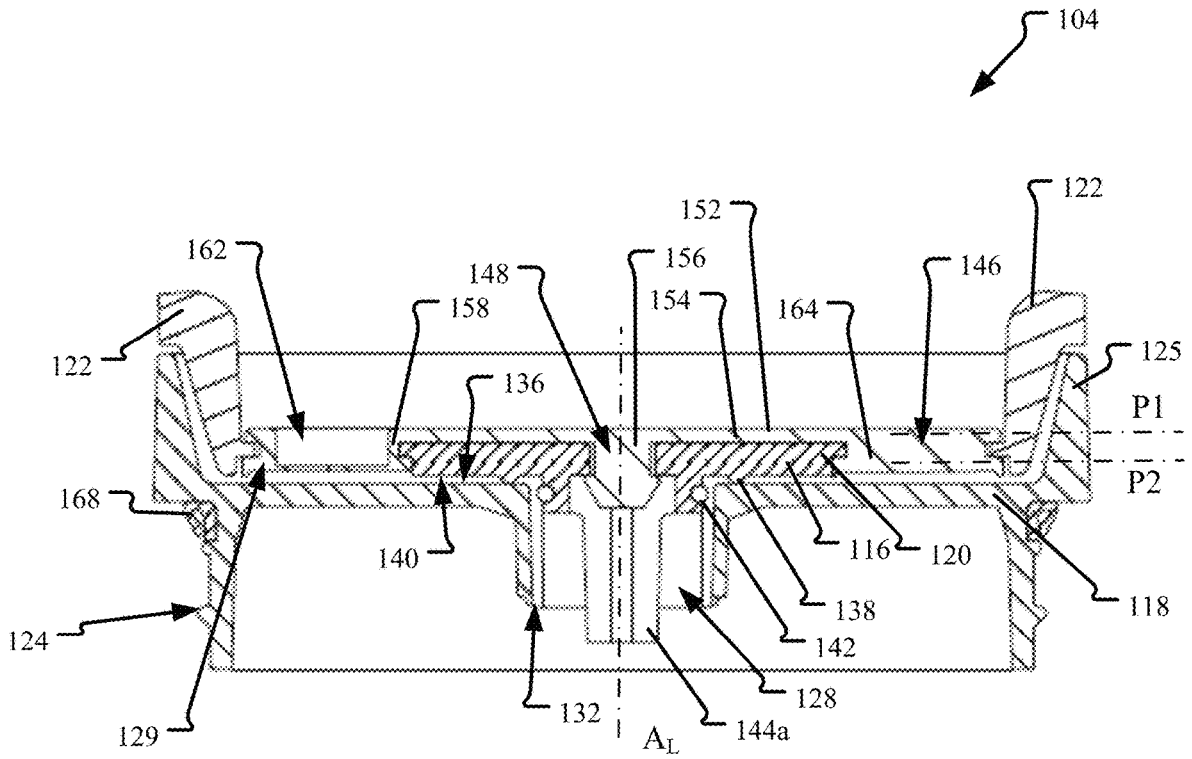

FIGS. 6A and 6B depict a top view and a sectional view, respectively, of the container lid 104 of FIGS. 1A and 1B in a fourth, intermediate position. FIGS. 4A-4B are described concurrently and not all components described are depicted in all figures, and certain components described above in FIGS. 1A-5B are not necessarily described further. In the depicted example, the cover 120 is rotated about 45 degrees, relative to the straw-receiving position of FIGS. 3A and 3B. In the intermediate position, the cover 120 is intermediate any of the positions depicted above, such that no detent 138 is engaged with any receptor 134. As such, the detents 138 rotatable slide along the upper surface 136 of the base 118, thus forming a gap or space between the base 118 and the cover 120. This reduces friction between these two components and eases rotation between the positions described above.

Figure 7:
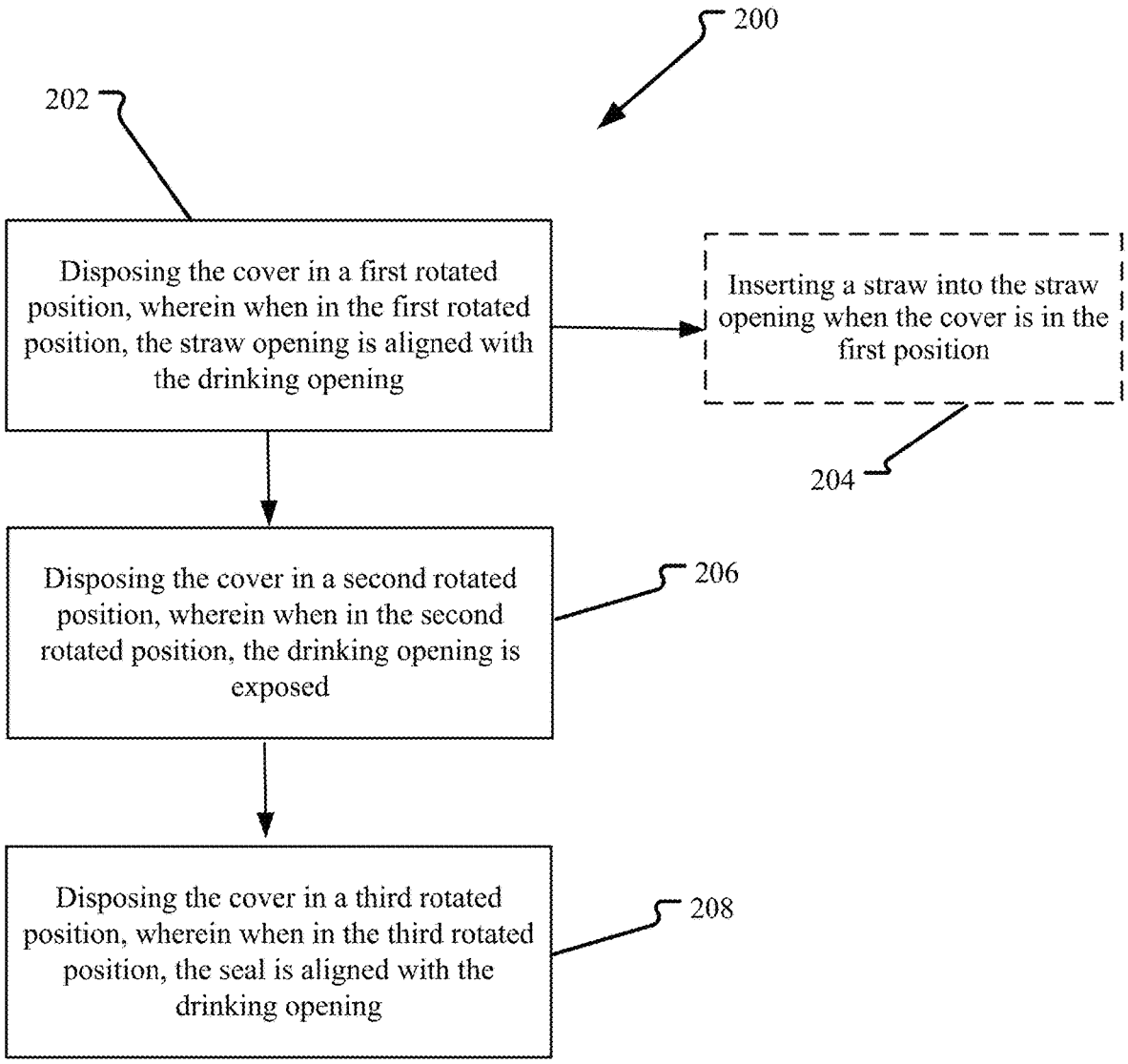
FIG. 7 depicts a method of using a container lid.

FIG. 7 depicts a method 200 of using a container lid, such as the multi-component, rotating container lid described herein. Such a beverage lid may include a base defining a drinking opening and a cover rotatably secured to the base. The cover may include a straw opening and a seal about the straw opening. The method begins with operation 202, disposing the cover in a first rotated position, wherein when in the first rotated position, the straw opening is aligned with the drinking opening. In optional operation 204, the method 200 may include inserting a straw into the straw opening when the cover is in the first position. Once inserted, the seal forms a seal around the straw so as to reduce or prevent leakage. Operation 206 contemplates disposing the cover in a second rotated position, wherein when in the second rotated position, the drinking opening is exposed. In operation 208, the cover is disposed in a third rotated position, wherein when in the third rotated position, the seal is aligned with the drinking opening.

This disclosure describes some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art. Any number of the features of the different examples described herein may be combined into one single example and alternate examples having fewer than or more than all of the features herein described are possible. Further, as used herein and in the claims, the phrase "at least one of element A, element B, or element C" is intended to convey any of: element A, element B, element C, elements A and B, elements A and C, elements B and C, and elements A, B, and C. It is to be understood that terminology employed herein is used for the purpose of describing particular examples only and is not intended to be limiting. It must be noted that, as used in this specification, the singular forms "a," "an," and "the" include plural referents unless the context clearly dictates otherwise. Further, one having skill in the art will understand the degree to which terms such as "about" or "substantially" convey in light of the measurement techniques utilized herein. To the extent such terms may not be clearly defined or understood by one having skill in the art, the terms such as "about" or "substantially" shall mean plus or minus ten percent.

Although specific examples were described herein, the scope of the technology is not limited to those specific examples. One skilled in the art will recognize other examples or improvements that are within the scope of the present technology. Therefore, the specific structure, acts, or media are disclosed only as illustrative examples. Examples according to the technology may also combine elements or components of those that are disclosed in general but not expressly exemplified in combination, unless otherwise stated herein. The scope of the technology is defined by the following claims and any equivalents therein.

The invention claimed is:

1. A container lid comprising:

a base defining (1) a base receiver centrally disposed in the base, and (2) a drinking opening off-center in the base; and a cover defining a straw opening, wherein the cover comprises:

a catch rotatably disposed in the receiver; and a gasket defining a slit aligned with the straw opening for receiving a straw, wherein the cover is rotatably positionable in a first position where the slit is aligned with the drinking opening, wherein the cover is rotatably positionable in a second position where the slit is mis-aligned with the drinking opening, wherein the gasket comprises a head, a tail, and a base connecting the head and the tail, wherein the head defines the slit, wherein the head and the tail are substantially coplanar and disposed in a first plane and wherein the base is disposed in a second plane non-coplanar to the first plane, and wherein the gasket further defines an anchor and wherein the cover defines an anchor receiver for receiving the anchor, and wherein the anchor, anchor receiver, and the base receiver are aligned.

2. The container lid of claim 1, wherein when the cover is in the second position, the drinking opening is exposed.

3. The container lid of claim 1, wherein the cover defines an opposite opening disposed opposite the straw opening, and wherein the head extends through the straw opening, and wherein the tail extends through the opposite opening.

4. The container lid of claim 1, wherein the base comprises an upper surface and the cover defines a lower surface.

5. The container lid of claim 4, wherein the upper surface of the base at least partially defines a first receptor and a second receptor and wherein the cover comprises a detent extending from the lower surface of the cover.

6. The container lid of claim 5, wherein when the cover is in the first position, the detent is engaged with the first receptor and wherein when the cover is in the second position, the detent is engaged with the second receptor.

7. The container lid of claim 1, wherein the gasket comprises a plurality of deflectable flaps.

8. The container lid of claim 1, further comprising an O-ring disposed around the catch.

9. The container lid of claim 1, wherein the base receiver defines a plurality of vent channels.

10. The container lid of claim 9, wherein the cover covers the plurality of vent channels when in the first position and in the second position.

11. The container lid of claim 1, wherein the cover is positionable in a third position where the tail is aligned with the drinking opening and wherein when the cover is in the second position, the tail is mis-aligned with the drinking opening.

12. The container lid of claim 11, wherein an upper surface of the base at least partially defines a first receptor, a second receptor, and a third receptor, and wherein the cover comprises a detent extending from a lower surface of the cover.

13. The container lid of claim 12, wherein:

when the cover is in the first position, the detent is engaged with the first receptor;

when the cover is in the second position, the detent is engaged with the second receptor; and, when the cover is in the third position, the detent is engaged with the third receptor.

14. A beverage container comprising the container lid of claim 1.

15. A method of using a container lid comprising a base defining a drinking opening and a cover rotatably secured to the base, wherein the cover comprises a straw opening defined by a gasket, wherein the gasket comprises a head, a tail, and a base connecting the head and the tail, wherein the head defines the slit, wherein the head and the tail are substantially coplanar and disposed in a first plane and wherein the base is disposed in a second plane non-coplanar to the first plane, and wherein the gasket further defines an anchor and wherein the cover defines an anchor receiver for receiving the anchor, and wherein the anchor, anchor receiver, and the base receiver are aligned, the method comprising:

disposing the cover in a first rotated position, wherein when in the first rotated position, the straw opening is aligned with the drinking opening;

disposing the cover in a second rotated position, wherein when in the second rotated position, the drinking opening is exposed; and disposing the cover in a third rotated position, wherein when in the third rotated position, the seal is aligned with the drinking opening.

16. The method of claim 15, further comprising inserting a straw into the straw opening when the cover is in the first position, thereby displacing the gasket.

17. The method of claim 16, wherein the container lid comprises a detent and receptor and wherein disposing the cover in at least one of the first position, the second position, and the third position engages the detent with the receptor.

* * * * *